US010737864B2

(12) United States Patent
Myerscough

(10) Patent No.: US 10,737,864 B2
(45) Date of Patent: Aug. 11, 2020

(54) CONTAINER

(71) Applicant: FRUGALPAC LIMITED, Brightwell, Ipswich (GB)

(72) Inventor: Martin Myerscough, Woodbridge (GB)

(73) Assignee: Frugalpac Limited, Brightwell, Ipswich (GB)

( * ) Notice: Subject to any disclaimer, the term of this patent is extended or adjusted under 35 U.S.C. 154(b) by 451 days.

(21) Appl. No.: 15/517,240

(22) PCT Filed: Oct. 6, 2015

(86) PCT No.: PCT/GB2015/052910
§ 371 (c)(1),
(2) Date: Apr. 6, 2017

(87) PCT Pub. No.: WO2016/055772
PCT Pub. Date: Apr. 14, 2016

(65) Prior Publication Data

US 2017/0240334 A1 Aug. 24, 2017

(30) Foreign Application Priority Data

Oct. 7, 2014 (GB) ..... 1417698.6

(51) Int. Cl.
*B65D 77/06* (2006.01)
*B65B 3/04* (2006.01)
(Continued)

(52) U.S. Cl.
CPC ..... *B65D 77/065* (2013.01); *B65B 3/04* (2013.01); *B65B 7/02* (2013.01); *B65B 43/00* (2013.01);
(Continued)

(58) Field of Classification Search
CPC ..... B65D 77/065; B65D 5/068; B65D 5/60; B65D 41/04; B65D 77/062; B65D 5/067;
(Continued)

(56) References Cited

U.S. PATENT DOCUMENTS 3,484,011 A * 12/1969 Soper ..... B65D 23/02 206/459.5
4,165,023 A * 8/1979 Schmit ..... B65D 47/122 222/105
4,214,675 A * 7/1980 Schmit ..... B65D 5/748 222/105
4,483,464 A 11/1984 Nomura
(Continued)

FOREIGN PATENT DOCUMENTS

DE 102010011208 9/2011
GB 1283207 * 7/1972 ..... B29C 65/76
(Continued)

OTHER PUBLICATIONS

International Search Report and Written Opinion of the International Searching Authority (PCT/IB2015/052910) dated Nov. 24, 2015, 11 pages.
(Continued)

*Primary Examiner* — Christopher R Demeree
(74) *Attorney, Agent, or Firm* — Burr & Brown, PLLC

(57) ABSTRACT

This invention relates to a container comprising and outer shell and an inner lining, to a method of construction of such a container and to components used in the construction of such a container. A container comprises an outer shell made from a first material comprising paperboard, and an inner lining made from a second material comprising a polymeric or metallic material, the lining defining an internal volume for holding a liquid, and the lining being adhered to the shell, wherein, the outer shell includes a line of weakness extending around at least part of the periphery of the shell and defining a first portion of the shell on one side of said line and a second portion of the shell on the other side of said line, the line of weakness permitting the first portion of the
(Continued)

shell to be separated from the second portion of the shell, and wherein, the lining is adhered to the shell in said first portion and the lining extends into to said second portion of the shell.

31 Claims, 7 Drawing Sheets

(51) Int. Cl.

| | |
|---|---|
| ***B65D 41/04*** | (2006.01) |
| ***B65B 43/00*** | (2006.01) |
| ***B65B 55/12*** | (2006.01) |
| ***B65D 5/06*** | (2006.01) |
| ***B65B 7/02*** | (2006.01) |
| ***B65D 5/60*** | (2006.01) |

(52) U.S. Cl.
CPC ..... *B65B 55/12* (2013.01); *B65D 5/068* (2013.01); *B65D 5/60* (2013.01); *B65D 41/04* (2013.01); *B65D 77/062* (2013.01)

(58) Field of Classification Search
CPC ..... B65D 5/40; B65D 5/606; B65D 23/02; B65D 77/06; B65D 2001/0827; B65D 3/0067; B65B 3/04; B65B 7/02; B65B 43/00; B65B 55/12; B31B 2120/40
USPC ..... 229/125.42, 117.3, 117.35, 213, 117.34, 229/249; 222/105, 183; 220/495.01
See application file for complete search history.

(56) References Cited

U.S. PATENT DOCUMENTS

| | | | | | |
|---|---|---|---|---|---|
| 4,560,090 | A * | 12/1985 | Okushita | B65D 5/606 | 222/105 |
| 4,660,737 | A | 4/1987 | Green et al. | | |
| 5,156,295 | A | 10/1992 | Gordon et al. | | |
| 5,829,637 | A * | 11/1998 | Takemura | B65D 5/603 | 222/81 |
| 6,637,623 | B2 * | 10/2003 | Muise | B65D 5/5045 | 222/105 |
| 7,007,825 | B2 * | 3/2006 | Crosland | B65D 5/10 | 222/105 |
| 7,077,309 | B2 * | 7/2006 | Andrews, Sr. | B65D 5/46104 | 229/117.14 |
| 7,628,314 | B2 * | 12/2009 | Huth | B65D 5/745 | 229/125.42 |
| 7,681,783 | B2 * | 3/2010 | Stephenson | B65D 5/46008 | 220/495.01 |
| 9,751,656 | B2 * | 9/2017 | Wolf | B65D 77/062 | |
| 2009/0094944 | A1 | 4/2009 | Friedrich | | |
| 2013/0233912 | A1 | 9/2013 | Piotrowski | | |

FOREIGN PATENT DOCUMENTS

| | | | | |
|---|---|---|---|---|
| NL | 1038351 | * | 5/2012 | B65D 5/40 |
| NL | 1038351 C | | 5/2012 | |
| WO | 2009/066257 | | 5/2009 | |

OTHER PUBLICATIONS

UK Search Report (GB1417698.6) dated Mar. 9, 2015, 1 page.

* cited by examiner

CONTAINER

BACKGROUND a. Field of the Invention

This invention relates to a container comprising an outer shell and an inner lining, to a method of construction of such a container and to components used in the construction of such a container.

b. Related Art

Many containers used to hold liquids and foodstuffs are made from a packaging laminate such as laminated paperboard or cardboard. These laminates typically include a thin layer of a plastics material such as polyethylene covering at least one side of a sheet of paperboard or other fibre-based material.

The laminate is folded to form the container so that the plastics layer is on the inside and provides a barrier layer that prevents the contents of the container from coming into contact with the paperboard.

A problem with these containers, however, is that they are not easy to recycle due to the intimate bond between the plastics layer and the paperboard. The whole container, therefore, typically ends up in landfill.

It is an object of the present invention to provide an improved container that overcomes this problem.

SUMMARY OF THE INVENTION

According to a first aspect of the present invention there is provided a container comprising:

- an outer shell made from a first material comprising paperboard; and
- an inner lining made from a second material comprising a polymeric or metallic material, the lining defining an internal volume for holding a liquid, and the lining being adhered to the shell,
- wherein, the outer shell includes a line of weakness extending around at least part of the periphery of the shell and defining a first portion of the shell on one side of said line and a second portion of the shell on the other side of said line, the line of weakness permitting the first portion of the shell to be separated from the second portion of the shell, and
- wherein, the lining is adhered to the shell in said first portion and the lining extends into said second portion of the shell.

In some embodiments of the container the lining is not adhered to the second portion of the shell. In other embodiments of the container it may be preferable if the lining is adhered to the shell in the second portion, the adhesion between the lining and the second portion of the shell being such that the lining can subsequently be peeled away from the second portion of the shell, so that the lining remains intact and no lining remains on the second portion of the shell, to fully separate the lining from the second portion of the shell.

Preferably the line of weakness is a line of perforations. Preferably the line of weakness extends around the full periphery of the container.

Preferably the lining is in the form of a pouch having an opening providing access to an interior of the pouch and wherein the pouch is adhered to the shell around the opening.

In preferred embodiments the container comprises a dispensing aperture in the first portion of the shell and wherein the lining is adhered to the shell around the aperture. In some of these embodiments the container comprises a spout and the spout is attached to the lining and protrudes through the aperture in the shell.

Preferably the container is a gable top container and at least a part of the line of weakness is provided in the gable top.

According to a second aspect of the present invention there is provided a packaging blank to be used in the manufacture of a container according to the first aspect of the invention, the blank being made from a sheet of unlaminated paperboard, and the blank having two opposing edges and a line of perforations extending between the edges.

Preferably the blank includes an aperture.

In preferred embodiments the blank is configured to form a gable top container. Preferably at least a part of the line of perforations extends across panels of the blank arranged to form said gable top.

According to a third aspect of the present invention there is provided a lining for use in the manufacture of a container, the lining comprising a pouch made from a sheet of material comprising a polymeric or metallic material, the pouch having an opening at a first end providing access to an interior of the pouch, and the pouch having a sealed edge at a second end, opposite the opening, the sealed edge having a convex curvature.

Preferably the lining includes an aperture proximate said opening.

According to a fourth aspect of the present invention there is provided an assembly for use in the manufacture of a container, the assembly comprising:

- a sheet of unlaminated paperboard, the sheet having two opposing edges and a line of weakness extending between said edges, a first region of the sheet being defined on one side of the line of weakness and a second region of the sheet being defined on the other side of the line of weakness, the sheet being configured to form an outer shell of the resultant container; and
- a lining pouch made from a sheet of material comprising a polymeric or metallic material, said pouch having an opening providing access to an interior of the pouch,
- wherein a part of said pouch adjacent the opening is adhered to the first region of the sheet, and the pouch extends over but is not adhered to the second region of the sheet.

In some embodiments the edges of the sheet are secured together such that the sheet forms a sleeve around said pouch.

The lining pouch is preferably adhered to the sheet fully around the opening of the pouch.

In some embodiments the sheet includes a first aperture and the lining pouch includes a second aperture and the first and second apertures are aligned. In these embodiments the lining pouch is preferably adhered to the sheet around said aligned apertures.

The lining pouch may be bonded together proximate the opening so as to seal an internal volume of the pouch. This allows the pouch to be sterilised and used in aseptic packaging. The strength of the bond is designed to be less then the strength of the adhesion between the pouch and the sheet, so that the bond may be broken to open the pouch without separating the lining from the shell.

According to a fifth aspect of the present invention there is provided a method of construction of a container comprising:

forming a sleeve made from a sheet of unlaminated paperboard material, the sleeve having a first end and a second end, and the sleeve including a line of weakness extending around the sleeve defining a first portion of the sleeve on one side of said line and a second portion of the sleeve on the other side of said line;

adhering a pouch to an internal surface of the sleeve in said first portion such that the pouch extends into said second portion, the pouch being made from a sheet of material comprising a polymeric or metallic material and the pouch having an opening providing access to an interior of the pouch;

sealing the second end of the sleeve to form a base of the container; and concurrently sealing the opening of the pouch and the first end of the sleeve to form a top of the container.

Preferably the pouch is adhered to the sleeve fully around the opening of the pouch.

In embodiments in which the container is to be used as aseptic packaging, the method preferably further comprises the step of bonding the pouch together along a closure bond line proximate the opening so as to seal an internal volume of the pouch, the strength of said bond being less then the strength of the adhesion between the pouch and the sleeve. Preferably the method further comprises the step of sterilising the pouch.

Preferably the pouch is adhered to the sleeve with the pouch and the sleeve in a flattened configuration. In these embodiments the method preferably comprises the step of expanding the sleeve so as to form a substantially tubular shape. The step of expanding the sleeve preferably causes the closure bond line to break thereby creating an opening of the pouch.

The method may further comprise the step of filling the pouch with a liquid before sealing the opening of the pouch.

In embodiments in which the sleeve includes a first aperture and the pouch includes a second aperture, the method preferably comprises aligning the first and second apertures, and adhering the pouch to the sleeve around the aligned apertures. The method may further comprise inserting a spout element through the aligned apertures, and bonding the spout element to the pouch.

The pouch is preferably adhered to the complete internal surface of the first portion of the sleeve.

In some embodiments at least a part of the first portion of the sleeve is folded to form a gable top of the container.

BRIEF DESCRIPTION OF THE DRAWINGS

The invention will now be further described by way of example only and with reference to the accompanying drawings, in which.

DETAILED DESCRIPTION

Figure 1:
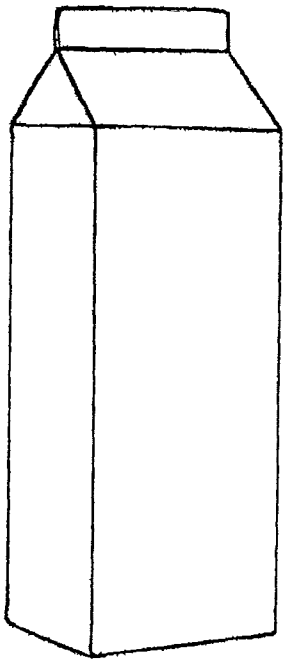
FIGS. 1 to 3 are prior art examples of containers made from a laminated packaging material.
Figure 2:
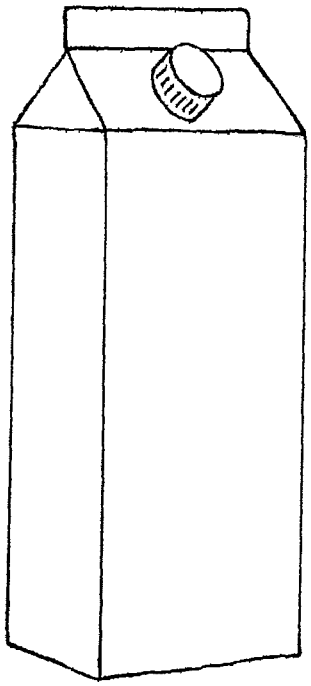
Figure 3:
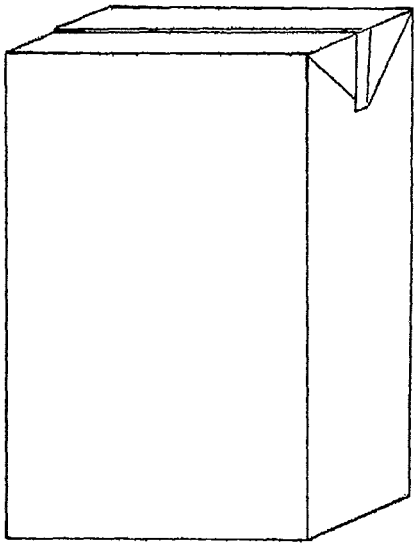

FIGS. 1 to 3 show examples of prior art containers that are traditionally made from a packaging laminate comprising paperboard and plastic. These containers are often referred to as Tetra Pak™ containers.

These containers have the advantage that they are quick to construct and fill, allowing large volumes of goods to be packaged in a short length of time; however, one major drawback of these containers is that they are difficult to recycle.

The present invention is concerned with providing an alternative container to each of these prior art containers that retains the speed of construction and filling, but which permits easier recycling of at least part of the container.

The following description describes embodiments of the invention in which the container is a gable-top container, having an external shape the same as or similar to the containers shown in FIGS. 1 and 2. It will be appreciated, however, that containers of the present invention include containers having a shape other than gable-top, and include, for example, containers having a shape as shown in FIG. 3.

The container 10 of the present invention includes an outer shell 12 made from an unlaminated paperboard material. This means that the paperboard material is not laminated with any layers of plastics materials or metallic sheets as is known in the art. The container 10 further comprises a lining or inner pouch 14 made of a material comprising a suitable polymeric or metallic material. The pouch 14 is designed to hold a liquid or foodstuff within the container 10 and is, accordingly, impermeable to liquids and provides a barrier between the liquid or foodstuff and the outer paperboard shell 12.

Figure 4:
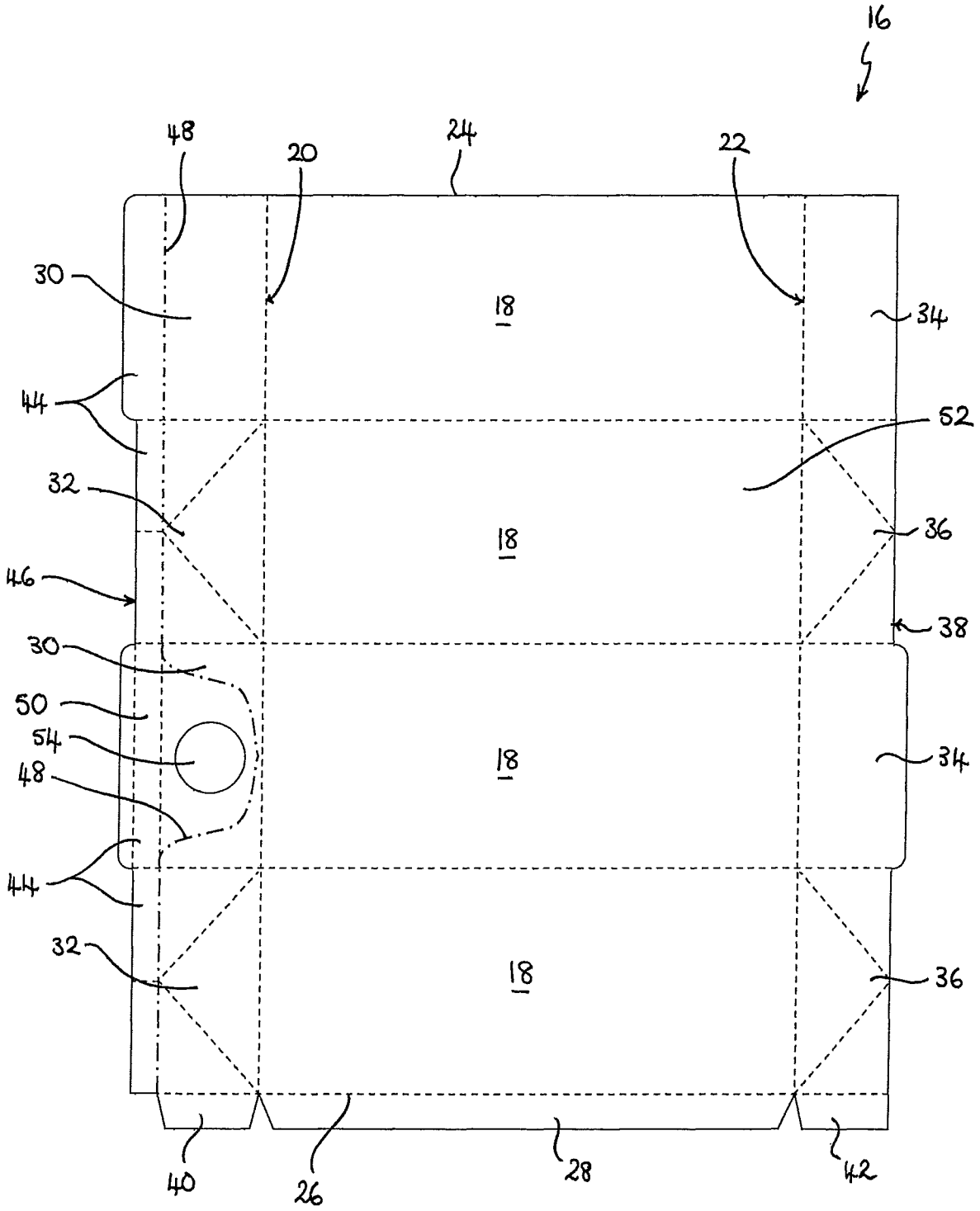
FIG. 4 is a net or blank for forming an outer shell of a container according to one aspect of the present invention.

An embodiment of a net or blank 16 for forming the outer shell 12 of a gable-top container 10 is shown in FIG. 4. The blank 16 includes a plurality of side wall panels 18, each having a first, top edge 20 and a second, bottom edge 22. The side wall panels are arranged adjacent to each other across the blank between opposing outer side edges 24, 26 of the blank 16. A first tab 28 extends from one side edge 26 of the blank 16 along a complete length of a side panel 18. Gable panels 30 and top gusset panels 32 extend from alternate top edges 20 of the side wall panels 18, and base panels 34 and bottom gusset panels 36 extend from alternate bottom edges 22 of the side wall panels 18. Edges of the base panels 34 and bottom gusset panels 36 opposite the side wall panels 18 define a bottom edge 38 of the blank 16. Second and third tabs 40, 42 extend from a top gusset panel 32 and a bottom gusset panel 36, respectively, at the side edge 26 of the blank 16. During construction of the container 10 the tabs 28, 40, 42 are bonded to the side wall panel 18, gable panel 30 and base panel 34, respectively, at the opposite side edge 24, to form a tube or sleeve as described in more detail below. Fin panels 44 additionally extend from the gable panels 30 and top gusset panels 32 on an opposite side to the side wall panels 18, as is known in the art. Edges of the fin panels 44 define a top edge 46 of the blank 16. Dashed lines in FIG. 4 denote fold lines of the blank 16.

A line of weakness 48 extends across the blank 16 between the side edges 24, 26. In this embodiment the line of weakness 48 comprises a line of perforations 48, indicated by the dot-dash line in FIG. 4. A first region 50 of the blank 16 is defined between the line of weakness 48 and the top edge 46 of the blank 16, and a second region 52 of the blank 16 is defined between the line of weakness 48 and the bottom edge 38 of the blank 16.

The line of weakness 48 preferably extends across the blank 16 such that the first region 50 is significantly smaller in area than the second region 52. That is to say, the line of weakness 48 is preferably positioned nearer to the top edge 46 of the blank 16 than to the bottom edge 38.

In preferred embodiments the line of weakness 48 extends across the blank 16 in an area between the top edges 20 of the side wall panels 18 and the top edge 46 of the blank 16. Accordingly the line of weakness 48 extends through the gable panels 30 and/or the top gusset panels 32 and/or the fin panels 44. In this example a part of the line of perforations 48 extends along the fold lines between the gable panels 30 and the fin panels and between the top gusset panels 32 and the fin panels 44.

In this embodiment the blank 16 further comprises an aperture 54 in one of the gable panels 30. The aperture 54 forms a dispensing aperture of the constructed container 10 through which a spout element 56 extends. The line of weakness 48 extends around this aperture 54 such that the aperture 54 is located in the first region 50 of the blank 16.

The lining 14 of the container 10 comprises a pouch 14 having an opening 58 providing access to an interior volume of the pouch 14. A top edge 60 of the pouch 14 surrounds and defines the opening 58. The pouch 14 provides a receptacle for the liquid, foodstuff or other good to be held within the container 10.

The pouch 14 is preferably made from a thin sheet 62 of a plastics material, such as polyethylene or ethylene vinyl alcohol (EVOH), or a metal foil material. The pouch may be made from a suitable laminate material. The thin sheet 62 is folded and bonded to form the pouch 14. In this way, edges of the thin sheet 62 are typically bonded together along a bottom edge 64 of the pouch 14 and along a side seam 66 extending between the bottom edge 64 and the opening 58. The side seam and the bottom edge may be a continuous bond line. In preferred embodiments the edges of the thin sheet 62 are heat sealed or welded together along the bottom edge 64 and the side seam 66 of the pouch 14.

Importantly the dimensions of the thin sheet 62, and of the resulting pouch 14, are such that a perimeter of the opening 58 of the pouch 14, i.e. a length of the top edge 60, is equal to the width of the blank 16, i.e. the distance between opposing side edges 24, 26 of the blank 16.

Figure 7:
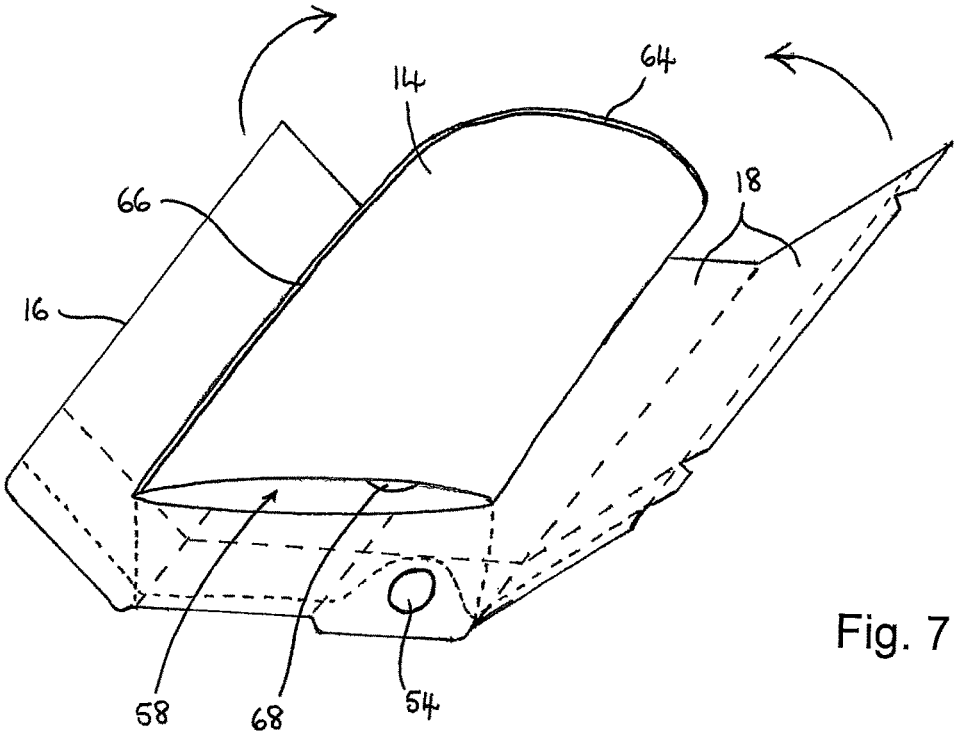
FIG. 7 is an illustration of one step in the assembly of a container according to the present invention.

In some embodiments it is advantageous if the bottom edge 64 of the pouch 14 has a convex curvature when the pouch 14 is in a flattened configuration, as illustrated in FIG. 7.

In embodiments of the container 10 including a dispensing aperture, the pouch 14 comprises an aperture 68 corresponding in size to the aperture 54 of the blank 16. Generally this aperture 68 in the pouch 14 will be located near to the top edge 60 of the pouch 14.

Figure 5:
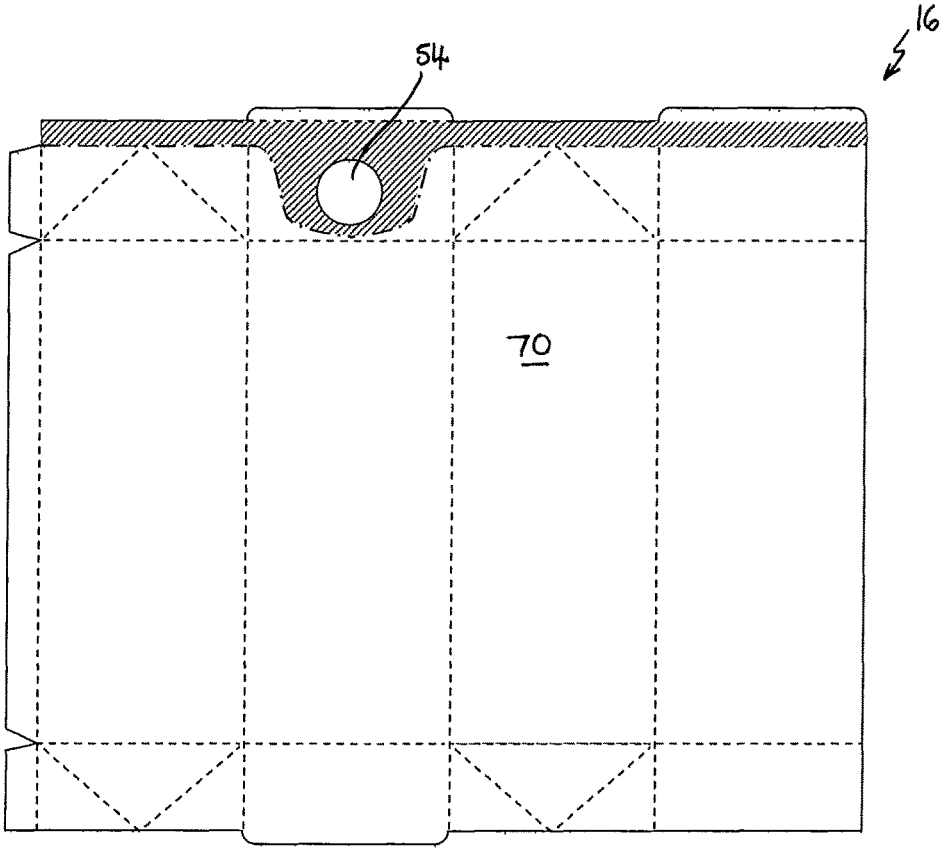
FIG. 5 is the blank of FIG. 4 showing areas of adhesion to a lining of the container.
Figure 6:
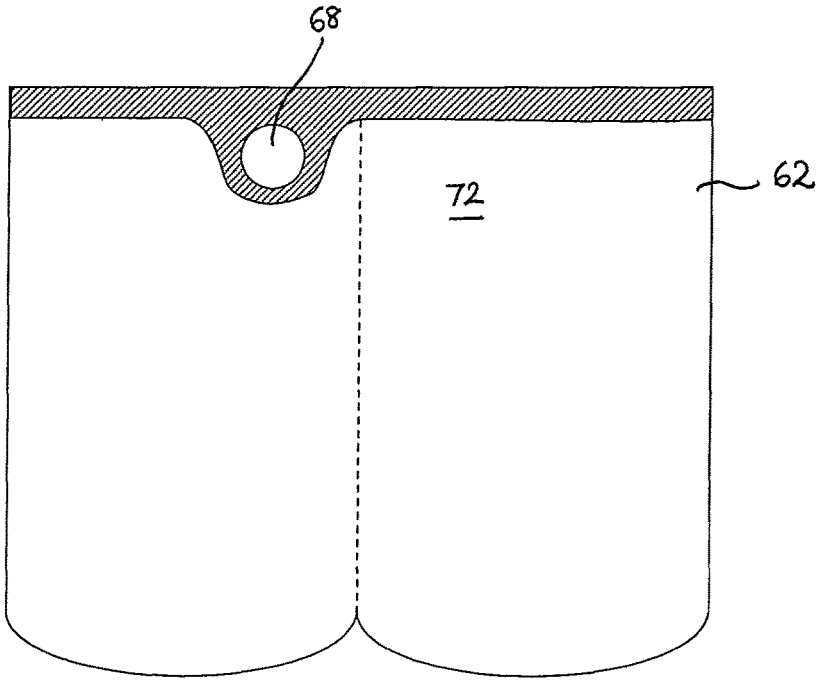
FIG. 6 is a plan view of a sheet of material used to form a lining of a container according to the present invention showing areas of adhesion to a shell of the container.

As illustrated in FIGS. 5, 6 and 7, to construct a container 10 according to the present invention, the lining pouch 14 is adhered to the paperboard blank 16 in the first region 50 of the blank 16. The shaded areas in FIGS. 5 and 6 illustrate the areas of adhesion between the blank 16 and the lining 14 in this embodiment. A layer of adhesive may be applied to one or both of a first, interior surface 70 of the blank 16 and a first, exterior surface 72 of the lining 14. The adhesive may be a heat activated adhesive, a pressure activated adhesive or a contact adhesive.

Importantly, the area of adhesion between the lining 14 and the blank 16 extends fully around the opening 58, i.e. the top edge 60, of the pouch 14, and in this example, fully around the apertures 54, 68 of the blank 16 and pouch 14. Furthermore, in this embodiment, the pouch 14 is not adhered to the blank 16 in the second region 52 of the blank. That is to say, the pouch 14 is not adhered to the blank 16 anywhere between the line of perforations 48 and the bottom edge 38 of the blank 16.

As shown in FIG. 7, in a preferred method of construction the pouch 14 is initially adhered to central panels of the blank 16. In this example the blank 16 comprises four side wall panels 18 and the pouch 14 is adhered to the blank 16 such that the pouch 14 extends over the two innermost panels 18. Accordingly, at least one side wall panel 18 adjacent each of the side edges 24, 26 of the blank 16 is not initially covered by the pouch 14. In this way, only half of the perimeter of the opening 58, or top edge 60, of the pouch 14 is adhered to the blank 16 in this first construction step.

In this example, the blank 16 and the pouch 14 include apertures 54, 68, and the pouch 14 is adhered to the blank 16 so that the apertures 54, 68 are aligned.

Side edges 24, 26 of the blank 16 are then brought together around the pouch 14 and bonded together using the tabs 28, 40, 42 so that a complete tube or sleeve 74 surrounds the pouch 14. The tabs 28, 40, 42 will typically be bonded to adjacent panels of the blank 16 by means of a suitable adhesive such as a heat sensitive or pressure sensitive adhesive.

As the blank 16 is folded over the pouch 14, the remaining, previously unadhered, area around the perimeter of the opening 58 of the pouch 14 is adhered to the first region 50 of the blank 16.

During the construction of the sleeve 74 and the adhesion of the pouch 14 to the blank 16, both the blank 16 and the pouch 14 are in a generally flattened or collapsed configuration to allow heat and pressure to be easily applied to the pouch 14 and blank 16. Following these construction steps, the partially constructed container 10 is expanded or opened such that the area of the opening 58 of the pouch 14 is increased and the sleeve 74 forms a tube having a substantially rectangular or circular cross-sectional shape perpendicular to the side wall panels 18.

A base 76 of the container 10 can then be formed by folding and bonding the base panels 34 and bottom gusset panels 36 of the blank 16 in a manner known in the art. Importantly the pouch 14 is not adhered or in any way bonded or attached to the base panels 34 or bottom gusset panels 36 during forming of the base 76 of the container 10. By shaping the bottom edge 64 of the pouch to have a generally convex curvature, as described above, the risk of the bottom of the pouch 14 being caught up as the base 76 of the container 10 is formed is minimised.

With the container 10 standing on its base 76, or supported such that the base 76 is lowermost, the lining pouch 14 is substantially suspended from an upper portion 92 of the shell 12 above the line of weakness 48. Preferably the dimensions of the pouch 14 are such that, when the pouch 14 is filled, at least some of the weight of the contents of the pouch 14 is borne by the base 76 of the shell 12, i.e. a part of the pouch 14 is seated on the base 76 of the shell 12.

Figure 9:
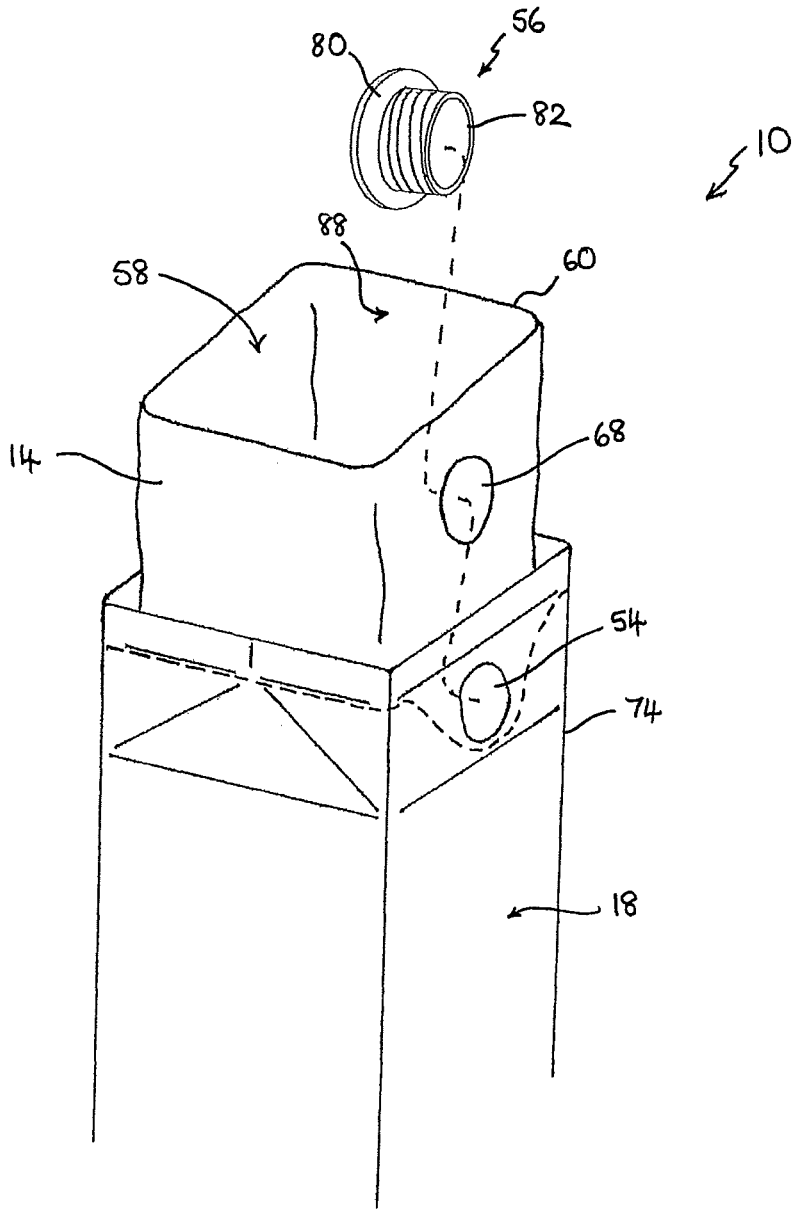
FIG. 9 is an exploded view of a part of a container according to the present invention showing a shell, a lining and a spout of the container.

As illustrated in FIG. 9, in embodiments including a spout element 56, this is typically inserted through the aligned apertures 68, 54 in the lining 14 and the shell 12 from an interior of the container 10 after the container 10 is expanded and before the container 10 is filled. The spout element 56 will generally include an attachment flange 80 at one end of a tubular spout 82. The spout 82 further includes screw threads 84 around an external surface for engaging with corresponding screw threads of a screw cap 86 (shown in FIG. 10) used to seal the spout 82 and therefore the dispensing aperture of the container 10.

The attachment flange 80 of the spout element 56 is bonded to an internal surface 88 of the lining 14 around the aperture 68. In embodiments in which the spout element 56 and lining 14 are both made of a plastics material, the flange 80 will typically be heat welded to the lining 14. In other embodiments the flange 80 may be adhered to the lining 14 by means of an adhesive or may be bonded to the lining 14 using any other suitable means to form a liquid-proof or leak-proof seal between the spout element 56 and the lining 14.

Because the lining 14 is adhered to the shell 12 around the aligned apertures 54, 68, the spout element 56 is also retained in a fixed position relative to the shell 12. In this way, during normal use, a user of the container 10 of the present invention has the same user experience as with a prior art laminated container.

Figure 8:
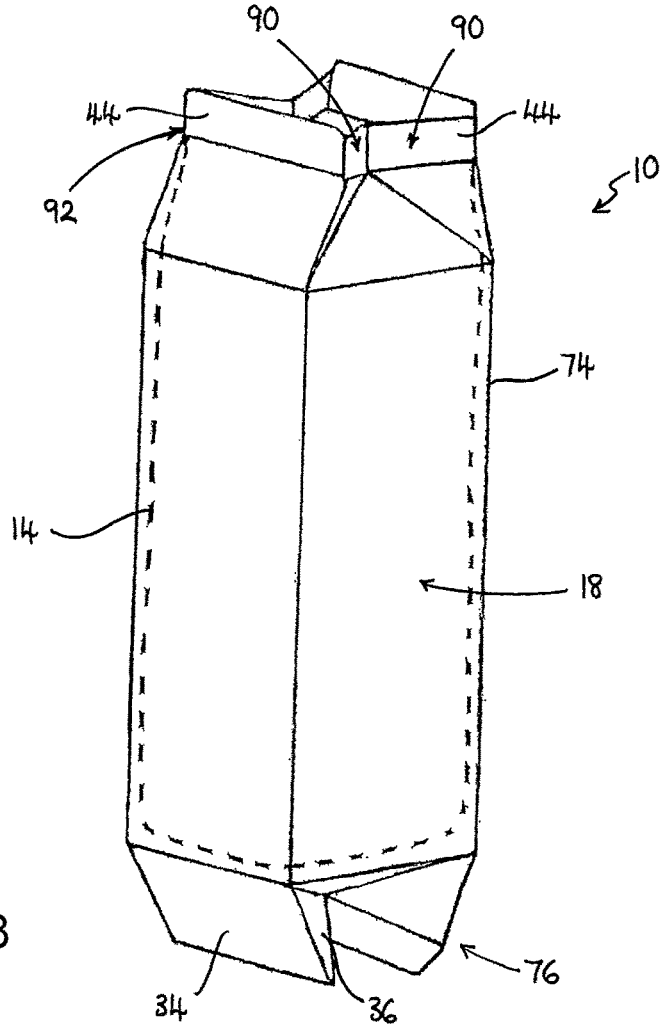
FIG. 8 is a perspective view of a partially assembled container according to the present invention.

Once the container 10 has been filled, the top of the container 10 is then closed and sealed. To form a gable-top of the container 10, the gusset panels 32, gable panels 30 and fin panels 44 are folded in the same way as in prior art gable-top containers. A partially folded gable-top is illustrated in FIG. 8.

In this example the lining pouch 14 is adhered to the internal surfaces of the fin panels 44. Accordingly, in embodiments in which the pouch 14 is made of a thin film of plastics material, the internal surfaces may be bonded together in the same manner as in traditional laminated containers. This is because the internal plastics lining 14 of the present container behaves in the same way as the inner coating of plastics material of a laminated container. Internal surfaces of the fin panels 44, which are covered by the lining 14 can, therefore, be bonded together by heat welding, i.e. by a combination of heat and pressure.

To fully form the gable-top, it is also necessary to bond together external surfaces 90 of the neighbouring portions of each of the fin panels 44 extending from the top gusset panels 32. Because the external surfaces 90 of the shell 12 are paperboard, it is necessary to bond these panels 44 together using a suitable adhesive.

In preferred embodiments a heat activated or a pressure activated adhesive is applied to these external surfaces 90 of the blank 16 before the shell 12 is constructed. Accordingly, when the internal surfaces of the fin panels 44 are heat welded by means of the application of heat and pressure, the adhesive on the external surfaces 90 is also activated to bond these panels 44 together.

In this way, the opening 58 of the pouch 14 and the top of the shell 12 are both closed and sealed in a single operation, i.e. a single application of heat and pressure.

Once a user has finished using the container 10, the lining pouch 14 can be separated from a part of the shell 12 so that the lining 14 and shell 12 can be disposed of or recycled separately.

To achieve this, a user tears along the line of weakness 48. In embodiments in which the line of weakness 48 is a line of perforations 48 that extends across the top of the container 10 and under the spout 82 of the container 10, a user preferably presses his or her thumb or finger under the spout 82 to start the separation. It will be appreciated that a user may, however, tear along the line of perforations 48 in any way. In some embodiments a part of the line of weakness or the line of perforations 48 may be weaker than in another part or other parts of the line of weakness or the line of perforations 48 in order to vary the strength required to tear along the line of weakness or perforations 48.

Tearing along the line of weakness 48 or the line of perforations 48, separates a first, upper portion 92 of the shell 12, corresponding to the first region 50 of the blank 16, from a second, lower portion 94 of the shell, corresponding to the second region 52 of the blank 16. Furthermore, because in this embodiment the lining 14 is adhered to the first portion 92 of the shell 12 but is not adhered to the second portion 94 of the shell 12, the lining 14 is also fully separated from the second portion 94 of the shell 12. This is illustrated in FIG. 10 for one embodiment of the container 10.

The second portion 94 of the shell 12, which is 100% paperboard, may be easily recycled in any papermill. The first portion 92 of the shell 12, the lining 14 and the spout element 56 (if present), will typically not be recyclable. However, the amount of material in this part of the container 10 is substantially less than the total amount of material in a prior art laminated container, which is often difficult to recycle due to a lack of suitable recycling facilities.

It will be appreciated that to maximise the amount of paperboard that can be recycled, the second portion 94 of the shell 12 should be as large as possible. To this end, the line of weakness 48 is preferably disposed as close to the top of the container 10 as possible in order to minimise the size of the first portion 92 of the container 10 adhered to the lining 14.

Figure 10:
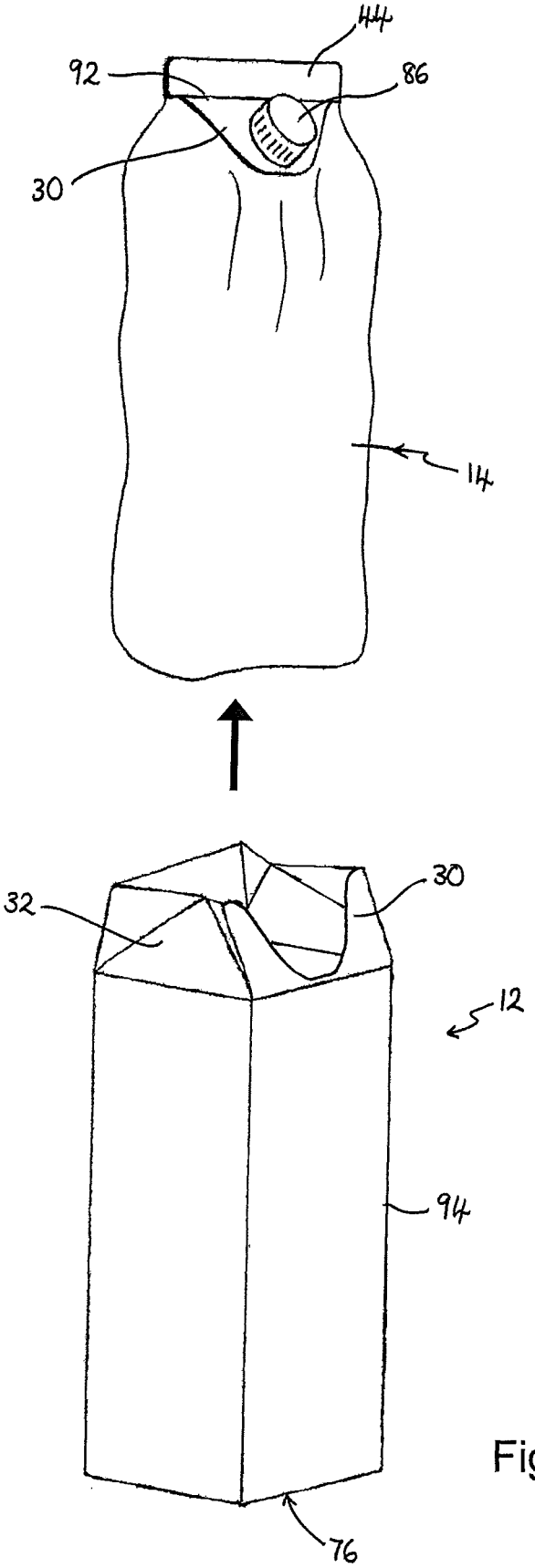
FIG. 10 illustrates the separation of a shell and a lining of a container according to the present invention.

In a particularly preferred embodiment of a gable-top container 10, shown in FIG. 10, the first portion 92 of the shell 12 comprises only the fin panels 44 and a part of one of the gable panels 30 surrounding the spout 82. In embodiments of gable-top containers 10 not including a spout 82 it is desirable if the first portion 92 of the shell 12 comprises only the fin panels 44, i.e. the line of perforations 48 extends along the fold lines between the fin panels 44 and the rest of the blank 16.

A further advantage of the present invention when applied to containers having a resealable dispensing aperture or element, such as a spout element 56, is that the lining 14 of the container 10 remains sealed when it is separated from the second portion 94 of the shell 12. Separation for disposal can, therefore, be achieved while liquid or other contents remain in the lining pouch 14, i.e. it is not necessary to fully empty the container 10 before the first and second portions 92, 94 are separated.

Although in the embodiment described above the lining was not adhered to the second portion of the shell, it some embodiments it may be desirable to partially or lightly adhere the lining to the second portion of the shell. The adhesion between the lining and the second portion of the shell should, however, be such that the lining can subsequently be peeled away or otherwise separated from the second portion of the shell, so that the lining remains intact and no lining remains on the second portion of the shell, to fully separate the lining from the second portion of the shell.

Adhering the lining to the second portion of the shell may assist in retaining the pouch in position with respect to the shell, especially during manufacture or construction of the container. In some embodiments, for example, the pouch may be tacked to the base of the shell.

The adhesion between the pouch and the second portion of the shell should be of a low peel strength such that a user can easily separate the lining fully from the second portion of the shell by hand.

Figure 11:
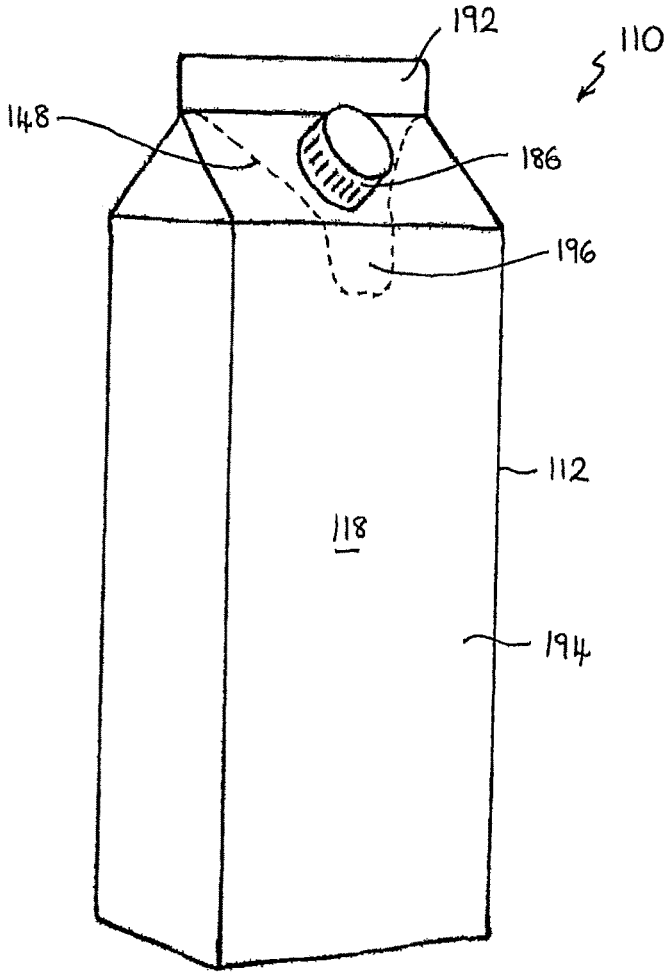
FIG. 11 is a perspective view of a container according to a further embodiment of the present invention.

FIG. 11 illustrates a further embodiment of a container 110 according to another preferred embodiment of the invention. In this embodiment the line of weakness or line of perforations 148 extends into one of the side panels 118 of the shell 112.

In particular the line of perforations 148 extends into a side panel 118 below the spout (screw cap 186 covering spout shown in FIG. 11).

The shape of the line of perforations 148 provides a region 196 of the side panel 118 located above the line of perforations 148 but below the spout, when the container 110 is stood on its base. It is envisaged that a user will separate the first and second portions of the shell 192, 194 by initially pressing inwardly on this region 196 and then tearing along the line of perforations 148 in a direction towards the top of the container 110.

Accordingly, the line of weakness or line of perforations 148 may be weaker in the side wall panel 118 than in the other panels of the shell 112, so that this initial tearing of the perforation is made easier for the user.

Figure 12:
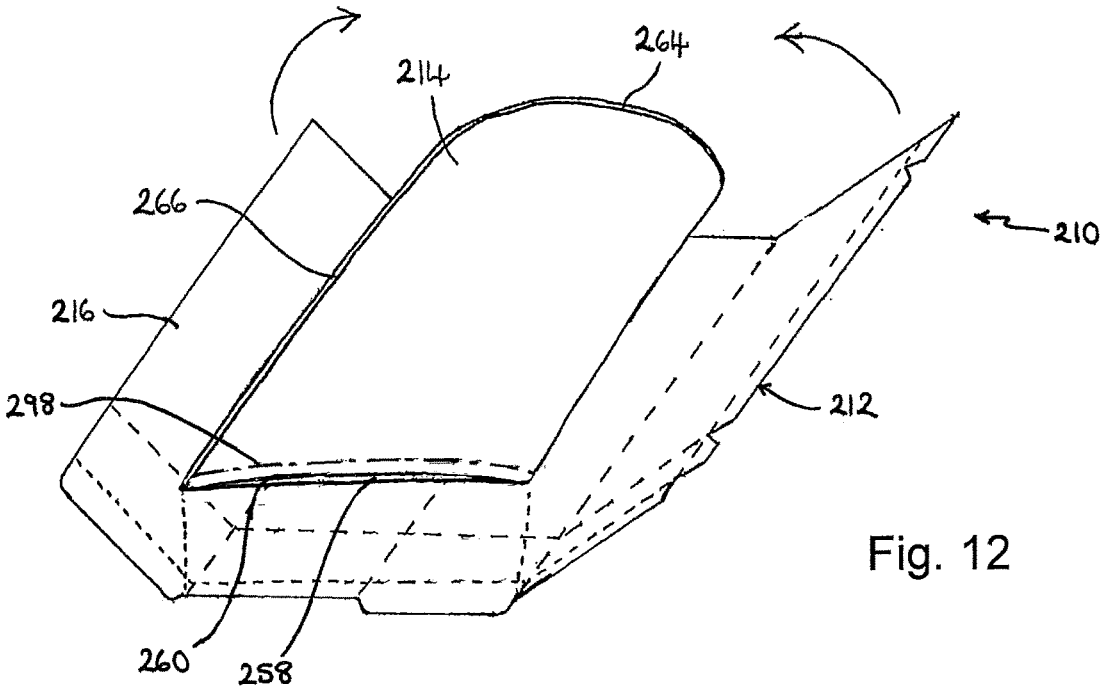
FIG. 12 is an illustration of one step in the assembly of a container according to another embodiment of the present invention.

FIG. 12 illustrates a step in the assembly of a container 210 according to a further embodiment of the present invention. The container 210 is designed to be used for aseptic packaging of foodstuffs such as milk and fruit juice. As in the embodiments described above, the container 210 includes an outer shell 212 made from cardboard or paperboard and an inner lining 214 in the form of a pouch made from a suitable barrier material comprising metal and/or polymer materials. In this embodiment the container 210 does not include a spout and, as such, neither the shell nor the pouch includes an aperture; however, it will be appreciated that in other embodiments a suitable aperture and pouring spout may be included in the pouch. Additionally, as in the embodiments described above, the shell includes a line of weakness to enable the lining 214 to be separated from a part of the shell 212.

The pouch 214 has an opening 258 providing access to an interior volume of the pouch 214, and a top edge 260 of the pouch 214 surrounds and defines the opening 258. The pouch 214 provides a receptacle for the sterile liquid, foodstuff or other good to be held within the container 210.

The pouch 214 is made from a thin sheet of a suitable plastics material, metal foil material, or laminate material that provides the necessary barrier properties. The material from which the pouch 214 is made should be suitable for sterilisation using one of the sterilisation techniques known in the art of aseptic packaging.

To manufacture a container 210 according to the invention, a pouch 214 is formed as described above in relation to earlier embodiments. In particular, edges of the thin sheet are typically bonded together along a bottom edge 264 of the pouch 214 and along a side seam 266 extending between the bottom edge 264 and the opening 258. In addition, the pouch 214 is lightly welded together across the top edge 260 of the pouch 214 so as to seal the opening 258. This closure weld line 298, indicated by a dot-dash line in FIG. 12, is sufficient to fully seal the opening 258 and prevent contamination of the interior of the pouch 214. The strength of the weld is, however, such that the weld may subsequently be broken to re-form the opening 258 in the pouch 214, as described further below. This closure weld line 298 will typically be formed by heat welding at a relatively low temperature and/or for a short period of time such that the sealing of the two layers of lining material is complete but not permanent.

Once the pouch 214 has been formed and the opening 258 has been sealed, the pouch 214 is then sterilised using a technique known in the art. The pouch 214 may be sterilised using chemicals or radiation, for example gamma radiation.

The sterilised pouch 214 is then adhered to a paperboard blank 216 as described above in relation to earlier embodiments, such that the blank 216 forms a complete tube or sleeve that surrounds the pouch 214. In particular, the area of adhesion between the lining 214 and the blank 216 extends fully around the opening 258, i.e. the top edge 260, of the pouch 214. Furthermore, the area of adhesion and the location of the closure weld line 298 is such that the closure weld line 298 is located within the area of adhesion. In other words, the parts of the lining 214 bonded together by the closure weld line 298 are adhered to the paperboard blank 216. The strength of the adhesion of the lining 214 to the shell 212 in this region is greater than the strength of the bond of the closure weld line 298.

During the construction of the sleeve and the adhesion of the pouch 214 to the blank 216, both the blank 216 and the pouch 214 are in a generally flattened or collapsed configuration to allow heat and pressure to be easily applied to the pouch 214 and blank 216.

The flattened container 210 may then be supplied to an aseptic filling machine to be filled with a sterilised product such as milk or fruit juice.

In a first step in the filling machine, the partially constructed container 210 is expanded such that the sleeve or shell 212 forms a tube having a substantially rectangular or circular cross-sectional shape. Because the strength of the adhesion of the lining 214 to the shell 212 is greater than the bond strength of the closure weld line 298, as the container 210 is expanded the closure weld line 298 breaks so that the layers of the lining 214 previously bonded together separate to re-form the opening 258 of the pouch 214.

The container 210 can then be filled with a sterile product in a sterile, or aseptic, environment. Once the container 210 has been filled, the top of the container 210 is then closed and sealed as described above.

It will be appreciated that in embodiments in which the container comprises a pouring spout, the pouring spout is attached to the lining before the pouch is sealed and prior to sterilisation of the pouch. Furthermore, in these embodiments, the closure weld line will extend across the pouch below the spout, i.e. between the spout and the bottom edge of the pouch, so as to fully seal an internal volume of the pouch.

The present invention, therefore, provides an improved container that overcomes problems with prior art containers made from a packaging laminate, as described above.

The invention claimed is:

1. A gable top container comprising:

an outer shell made from a first material comprising paperboard, the shell comprising gable panels and fin panels forming said gable top; and an inner lining in the form of a pouch having a sealed opening, prior to sealing the opening permitting filling of the pouch, the lining being made from a second material comprising a polymeric or metallic material, the lining defining an internal volume for holding a liquid, and the lining being adhered to the shell, wherein, the outer shell includes a line of weakness extending around at least part of the periphery of the shell and defining a first portion of the shell on one side of said line and a second portion of the shell on the other side of said line, the line of weakness permitting the first portion of the shell to be separated from the second portion of the shell, and characterised in that, the lining is adhered around the sealed opening to the fin panels in said first portion and the lining extends into said second portion of the shell and at least a part of the line of weakness [1] extends through at least a portion of at least one of the gable panels, [2] extends through at least a portion of at least one of the fin panels, or [3] extends between at least a portion of one of the gable panels and at least a portion of one of the fin panels.

2. A container as claimed in claim 1, wherein the lining is not adhered to the second portion of the shell.

3. A container as claimed in claim 1, wherein the lining is adhered to the shell in said second portion, and the adhesion between the lining and the second portion of the shell is such that the lining can subsequently be peeled away from the second portion of the shell, so that the lining remains intact and no lining remains on the second portion of the shell, to fully separate the lining from the second portion of the shell.

4. A container as claimed in claim 1, wherein the line of weakness is a line of perforations.

5. A container as claimed in claim 1, wherein the line of weakness extends around the full periphery of the container.

6. A container as claimed in claim 1, wherein the line of weakness extends along fold lines between the gable panels and the fin panels.

7. A container as claimed in claim 1, in which the container comprises a dispensing aperture in the first portion of the shell and wherein the lining is adhered to the shell around said aperture.

8. A container as claimed in claim 7, wherein the container comprises a spout and wherein the spout is attached to the lining and protrudes through said aperture in the shell.

9. A container as claimed in claim 8, wherein the spout is attached to an internal surface of the lining.

10. A container as claimed in claim 1, wherein the sealed opening is at a first end of the pouch, and the pouch has a sealed edge at a second end, opposite said sealed opening, the sealed edge having a convex curvature.

11. A container as claimed in claim 1, wherein a first part of the line of weakness extends between a gable panel and a fin panel, and a second part of the line of weakness extends through a gable panel.

12. A packaging blank to be used in the manufacture of an outer shell of a gable top container, the blank being made from a sheet of unlaminated paperboard and comprising gable panels and fin panels, the gable panels and fin panels forming said gable top of the container, and the blank having two opposing edges and a line of weakness extending between said edges, and characterised in that at least a part of the line of weakness [1] extends through at least a portion of at least one of the gable panels, [2] extends through at least a portion of at least one of the fin panels, or [3] extends between at least a portion of one of the gable panels and at least a portion of one of the fin panels, thereby defining a first region of the blank on one side of said line and a second region of the blank on the other side of said line.

13. A packaging blank as claimed in claim 12, wherein the blank includes an aperture in one of the gable panels.

14. A packaging blank as claimed in claim 13, wherein the line of weakness extends around the aperture such that the aperture is located in the first region of the blank between the line of weakness and a top edge of the blank.

15. A packaging blank as claimed in claim 12, wherein the line of weakness is a line of perforations and a part of the line of perforations extends along fold lines of the blank between the gable panels and the fin panels.

16. An assembly for use in the manufacture of a gable top container, the assembly comprising:

a blank made from a sheet of unlaminated paperboard, the blank comprising gable panels and fin panels configured to form said gable top of the container, and the blank having two opposing edges and a line of weakness extending between said edges, a first region of the blank being defined on one side of the line of weakness and a second region of the blank being defined on the other side of the line of weakness, the blank being configured to form an outer shell of the resultant container; and a lining pouch made from a sheet of material comprising a polymeric or metallic material, said pouch having an opening providing access to an interior of the pouch, characterised in that a part of said pouch adjacent the opening is adhered to at least one of the fin panels in the first region of the blank, and the pouch extends over but is not adhered to the second region of the blank, and at least a part of the line of weakness [1] extends through at least a: portion of at least one of the gable panels, [2] extends through at least a portion of at least one of the fin panels, or [3] extends between at least a portion of one of the gable panels d at least a portion of one of the fin panels.

17. An assembly as claimed in claim 16, wherein said edges of the blank are secured together such that the blank forms a sleeve around said pouch.

18. An assembly as claimed in claim 17, wherein the lining pouch is adhered to the blank fully around the opening of the pouch.

19. An assembly as claimed in claim 16, in which the blank includes a first aperture and the lining pouch includes a second aperture and wherein the first and second apertures are aligned.

20. An assembly as claimed in claim 19, wherein the lining pouch is adhered to the blank around said aligned apertures.

21. An assembly as claimed in claim 19, further comprising a spout, the spout being bonded to an internal surface of the lining pouch around the second aperture.

22. An assembly as claimed in claim 16, wherein the lining pouch is bonded together proximate the opening so as to seal an internal volume of the pouch, the strength of said bond being less than the strength of the adhesion between the pouch and the blank.

23. A method of construction of a gable top container comprising:

foaming a sleeve made from a sheet of unlaminated paperboard material, the sleeve having a first end and a second end and the sleeve including gable panels and fin panels configured to form said gable top, and the sleeve including a line of weakness extending around the sleeve, at least a part of the line of weakness [1] extending through at least a portion of at least one of the gable panels, [2] extending through at least a portion of at least one of the fin panels, or [3] extending between at least a portion of one of the gable panels and at least a portion of one of the fin panels thereby defining a first portion of the sleeve on one side of said line between said line and the first end and a second portion of the sleeve on the other side of said line between said line and the second end;

adhering a lining pouch to an internal surface of the sleeve in said first portion such that the pouch extends into said second portion, the pouch being made from a sheet of material comprising a polymeric or metallic material and the pouch having an opening providing access to an interior of the pouch, the pouch being adhered to the fin panels of the sleeve around said opening;

sealing the second end of the sleeve to form a base of the container; and concurrently sealing the opening of the pouch and the first end of the sleeve to form said gable top of the container.

24. A method as claimed in claim 23, wherein the pouch is adhered to the sleeve fully around the opening of the pouch.

25. A method as claimed in claim 23, further comprising the step of bonding the pouch together along a closure bond line proximate the opening so as to seal an internal volume of the pouch, the strength of said bond being less than the strength of the adhesion between the pouch and the sleeve.

26. A method as claimed in claim 25, wherein the pouch is adhered to the sleeve with the pouch and the sleeve in a flattened configuration and the method comprises the step of expanding the sleeve, and wherein the step of expanding the sleeve causes the closure bond line to break thereby creating an opening of the pouch.

27. A method as claimed in claim 25 further comprising the step of sterilising the pouch.

28. A method as claimed in claim 23 further comprising the step of filling the pouch with a liquid before sealing the opening of the pouch.

29. A method as claimed in claim 23, wherein the sleeve includes a first aperture and the pouch includes a second aperture and wherein the method comprises:

aligning the first and second apertures; and adhering the pouch to the sleeve around said aligned apertures.

30. A method as claimed in claim 29 further comprising:

inserting a spout element through the aligned apertures; and bonding the spout element to an internal surface of the pouch.

31. A method as claimed in claim 23, wherein the pouch is adhered to the complete internal surface of the first portion of the sleeve.

* * * * *